US009192259B2

(12) United States Patent
Koskovich

(10) Patent No.: US 9,192,259 B2
(45) Date of Patent: Nov. 24, 2015

(54) SHOE REMOVER

(71) Applicant: Richard Koskovich, Homer, AK (US)

(72) Inventor: Richard Koskovich, Homer, AK (US)

( * ) Notice: Subject to any disclaimer, the term of this patent is extended or adjusted under 35 U.S.C. 154(b) by 0 days.

(21) Appl. No.: 14/667,782

(22) Filed: Mar. 25, 2015

(65) Prior Publication Data

US 2015/0272366 A1 Oct. 1, 2015

Related U.S. Application Data

(60) Provisional application No. 61/972,636, filed on Mar. 31, 2014.

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/84; A47G 25/86
USPC ..... 223/113–117
See application file for complete search history.

(56) References Cited

U.S. PATENT DOCUMENTS

| | | | | |
|---|---|---|---|---|
| 30,913 A | | 12/1860 | Durham | |
| 54,948 A | | 5/1866 | Pierpont | |
| 70,275 A | | 10/1867 | Seymour, Jr. | |
| 89,633 A | | 5/1869 | Cullen | |
| 174,433 A | * | 3/1876 | Phenix | 223/115 |
| 275,551 A | * | 4/1883 | Walker | 223/115 |
| 1,893,280 A | | 1/1933 | Gerfen | |
| 4,226,346 A | | 10/1980 | Turner | |
| 4,394,946 A | | 7/1983 | McCormick | |
| D275,814 S | | 10/1984 | Windsor | |
| 4,653,679 A | | 3/1987 | Lojko et al. | |
| 5,516,015 A | | 5/1996 | Berzins et al. | |
| 5,806,729 A | * | 9/1998 | Ramon | 223/115 |

FOREIGN PATENT DOCUMENTS

| | | |
|---|---|---|
| CA | 2196620 A1 | 9/1998 |
| CN | 202932663 U | 5/2013 |
| GB | 2116830 A | 10/1983 |

* cited by examiner

*Primary Examiner* — Nathan Durham
(74) *Attorney, Agent, or Firm* — Wood, Herron & Evans, LLP

(57) ABSTRACT

A shoe remover includes a first member having first and second end portions, the first end portion having at least one aperture associated therewith and the second end portion being configured to engage a shoe. The shoe remover further includes a second member having first and second end portions, the first end portion being positioned proximate the first end portion of the first member and the second end portion being configured to contact a support surface. The shoe remover still further includes a pin pivotally coupling the first member and the second member and a lock member coupled to the second member. The lock member has at least one rod extending therefrom, the at least one rod being configured to releasably engage with the at least one aperture.

20 Claims, 6 Drawing Sheets

SHOE REMOVER

CROSS REFERENCE TO RELATED APPLICATION

This application claims the benefit of U.S. Provisional Patent Application Ser. No. 61/972,636 to Koskovich, filed Mar. 31, 2014, the disclosure of which is incorporated by reference in its entirety.

TECHNICAL FIELD OF THE INVENTION

This invention relates to a shoe remover, and more particularly, to a transportable shoe remover.

BACKGROUND OF THE INVENTION

Shoes, such as boots, may not be easily removed, and, thus, shoe removers, such as boot jacks, may be employed to aid the wearer in removing his or her shoe without having to bend portion over or sit down. However, most of the current shoe removers are heavy and/or unwieldy, such that they are not easily transported. Moreover, present shoe removers that are capable of folding are often not as stable as traditional (i.e., not foldable) shoe removers.

SUMMARY OF THE INVENTION

The invention of this application comprises a shoe remover including a first member having first and second ends. The first end portion of the first member has at least one aperture associated therewith, and the second end portion of the first member is configured to engage a shoe. The shoe remover also includes a second member having first and second ends. The first end portion of the shoe remover is positioned proximate the first end portion of the first member, and the second end portion of the shoe remover is configured to contact a support surface. A pin pivotally couples the first member and the second member. The shoe remover further includes a lock member coupled to the second member. The lock member has at least one rod extending therefrom, and the rod is configured to releasably engage with the at least one aperture.

The invention of this application includes a method of using a shoe remover. The shoe remover includes a first member having first and second ends. The first end portion of the first member has at least one aperture associated therewith, and the second end portion of the first member is configured to engage shoe. The shoe remover also includes a second member having first and second ends. The first end portion of the shoe remover is positioned proximate the first end portion of the first member, and the second end portion of the shoe remover is configured to contact a support surface. A pin pivotally couples the first member and the second member. The shoe remover further includes a lock member coupled to the second member. The lock member has at least rod extending therefrom, and the rod is configured to releasably engage with the at least one aperture. The shoe remover further includes an upright support positioned proximate the first ends of the first and second members, the upright support being configured to contact the support surface. The method includes pivoting at least one of the first and second members relative to the other of the first and second members until the at least one rod is substantially aligned with the at least one aperture and engaging the at least one rod with the at least one aperture. The method also includes placing each of the second end portion of the second member and the upright support on the support surface and engaging a shoe with the second end portion of the first member and using the shoe remover to remove the shoe. The method further includes pulling the lock member toward the second end portion of the second member so as to disengage the at least one rod from the at least one aperture and pivoting the at least one of the first and second members toward the other of the first and second members.

These and other advantages of the present invention will more readily become apparent from the description of the drawings herein, in which:

DETAILED DESCRIPTION OF THE INVENTION

Figure 1:
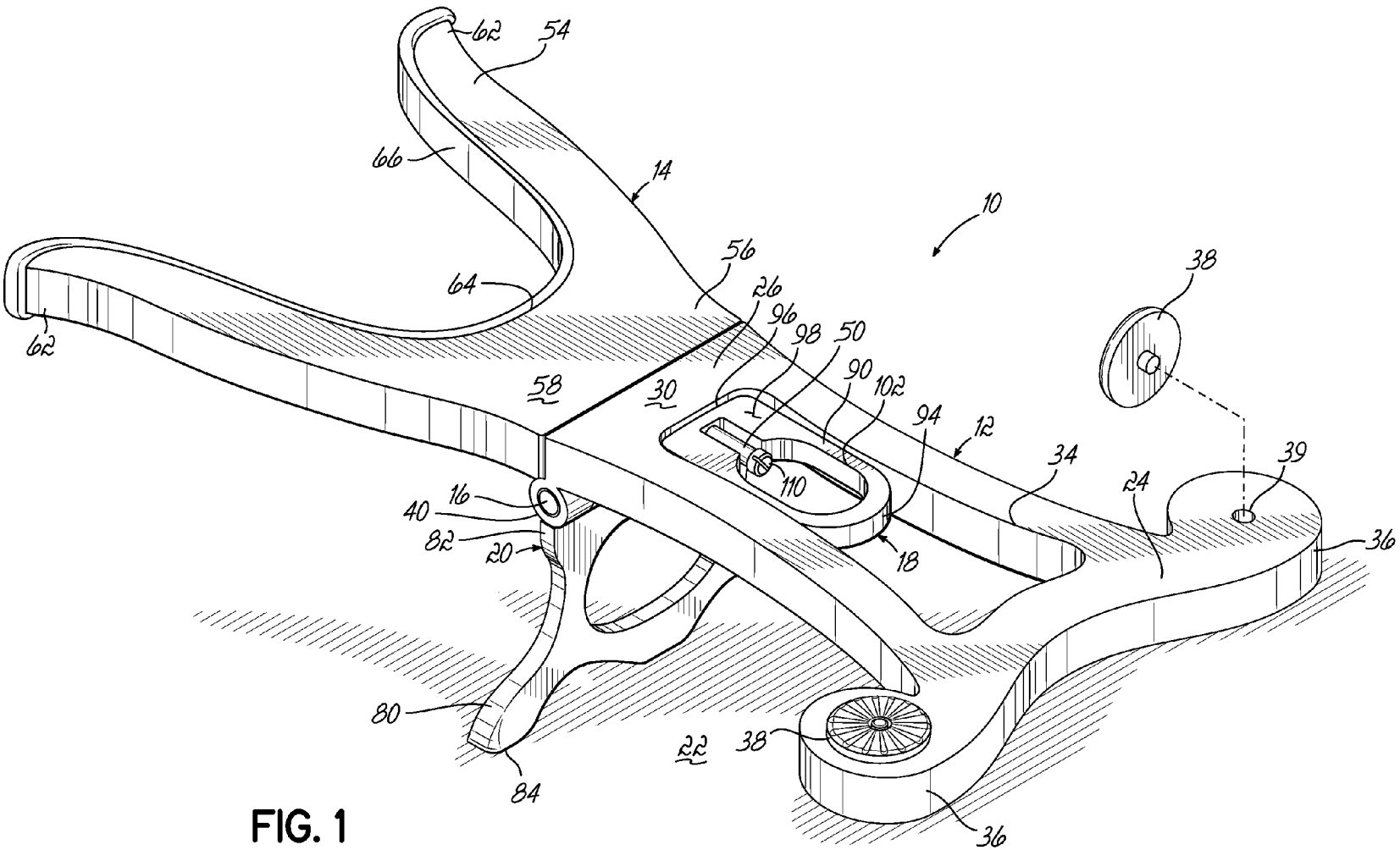
FIG. 1 is an isometric view of a shoe remover according to aspects of the present invention.
Figure 2:
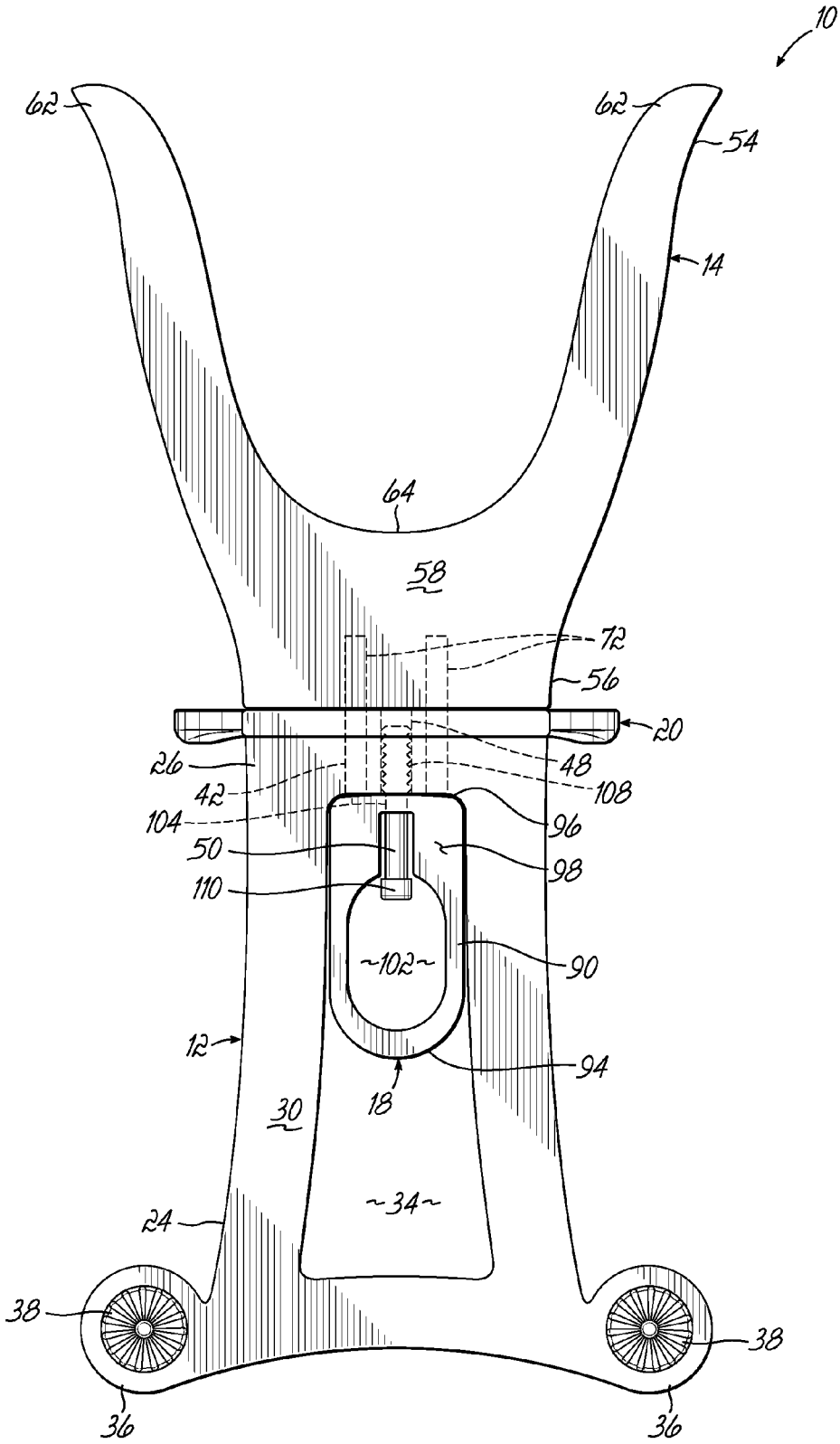
FIG. 2 is a top view of the shoe remover of FIG. 1, in which the shoe remover is in a locked position.
Figure 2A:
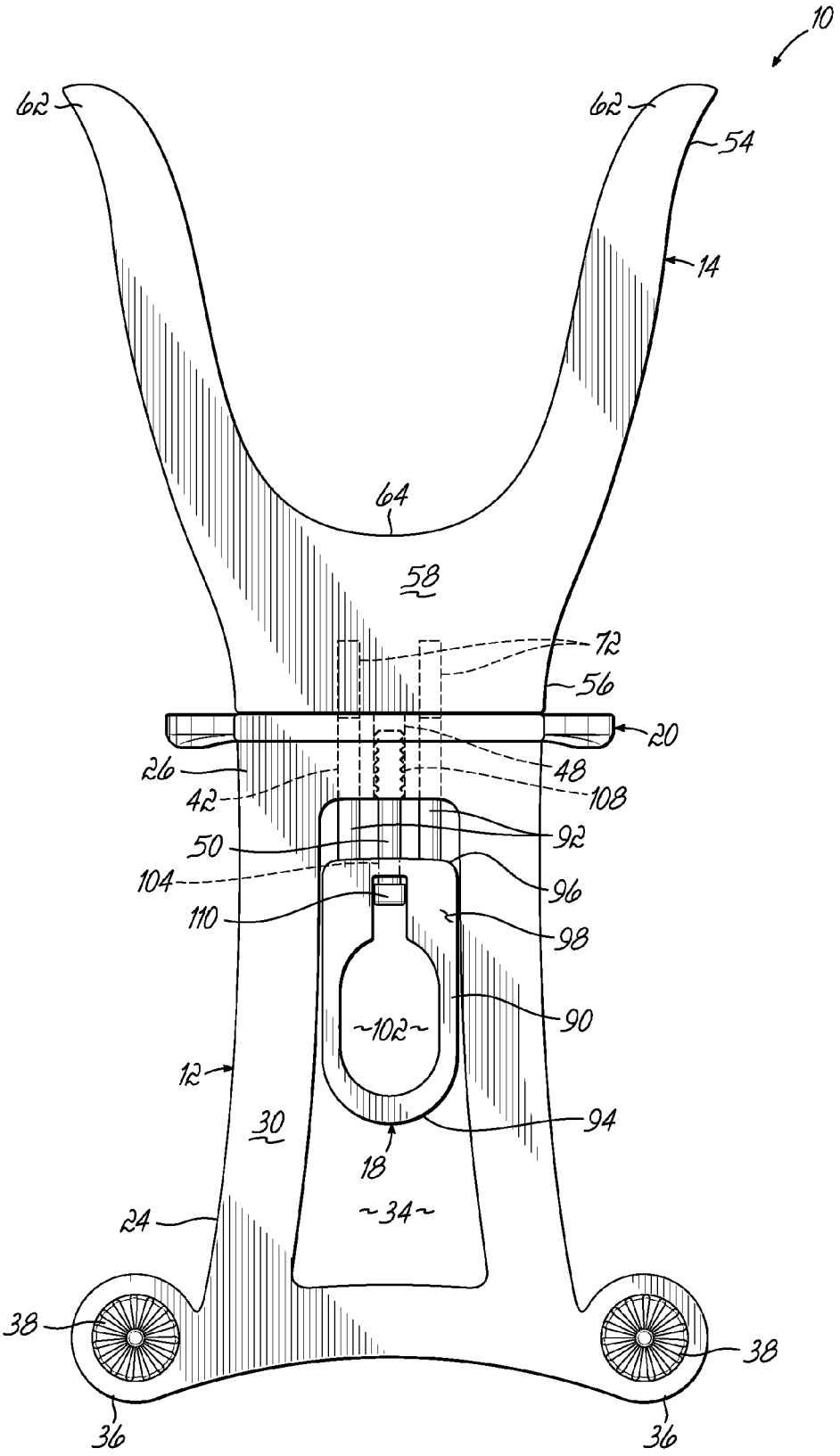
FIG. 2A is a top view of the shoe remover of FIG. 1, in which the shoe remover is in an unlocked position.

Referring to FIGS. 1-2A, a shoe remover 10 is shown. The shoe remover 10, also known as a boot jack, is configured to be used to assist in the removal of boots or other shoes. The shoe remover 10 includes members 12, 14, a pin 16, a lock member 18, and an upright support 20. Generally, the member 12 is configured to contact a support surface 22, and the member 14 is configured to engage a shoe (not shown).

Figure 3:
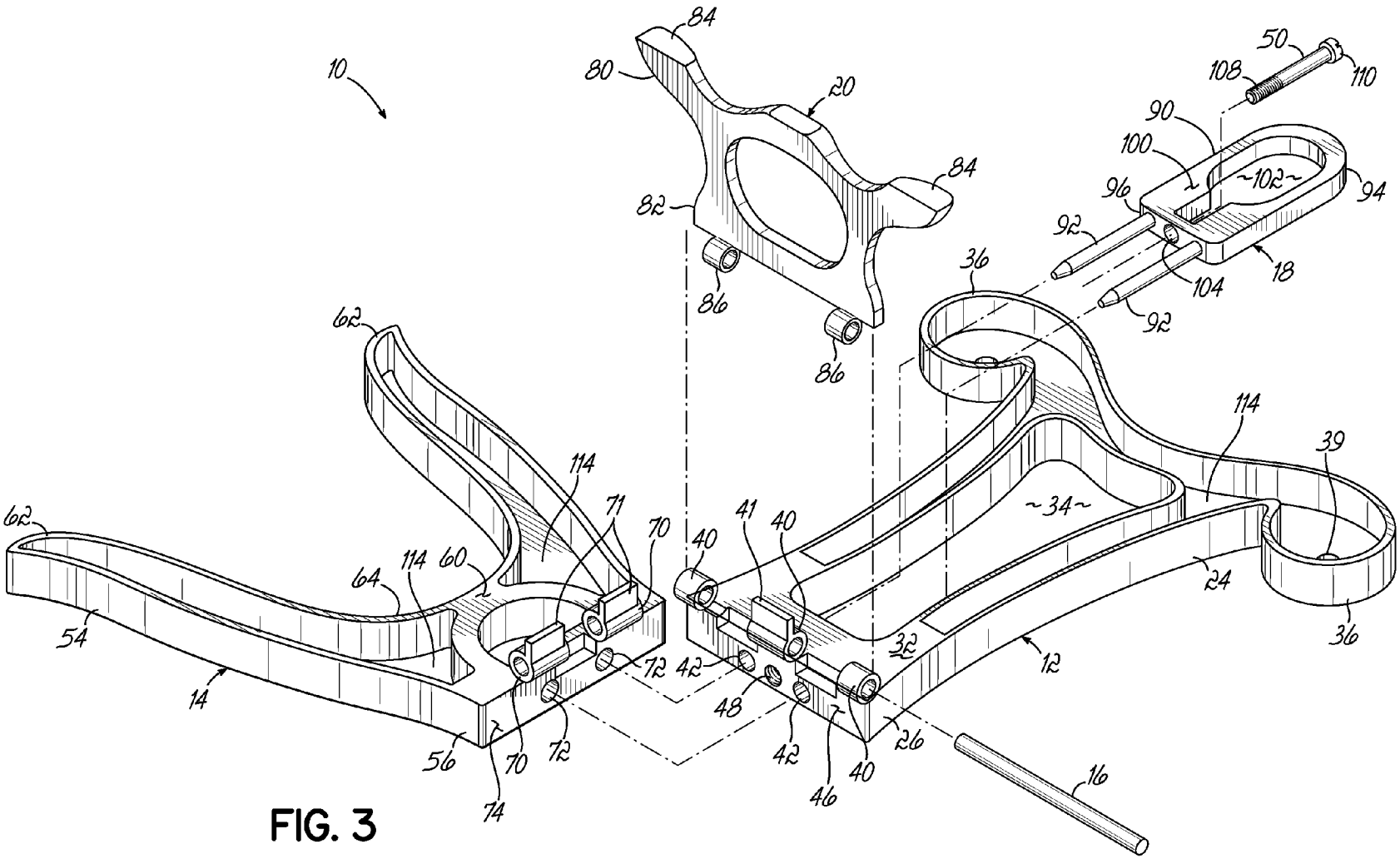
FIG. 3 is an exploded view of the shoe remover of FIG. 1.

The member 12 may be generally considered a floor engagement member. The member has end portions 24, 26 and an upper surface 30 and a lower surface 32 (FIG. 3). In an opened position for use, the upper surface 30 faces away from the support surface 22, and the lower surface 32 faces the support surface 22. The upper surface 30 is substantially planar.

The member 12 includes a cutout 34 running between the upper and lower surfaces 30, 32 and positioned intermediate the end portions 24, 26. The cutout 34 should be shaped and sized so as to provide room for the lock member 18 to be positioned therein and to be translated into an unlocked position, as will be described in detail below. One of ordinary skill will appreciate that the cutout 34 may have a variety of shapes and sizes.

The end portion 24 is configured to contact the support surface 22, such as a floor or ground. In the illustrated embodiment, the end portion 24 comprises feet 36 that contact the support surface 22. The feet 36 are positioned at the outermost edges of the member 12 and effectively increase a width of the member 12 at the end portion 24. As such, the feet 36 provide additional stability for the shoe remover 10 when it is in contact with the support surface 22. One of ordinary skill will appreciate, however, that the end portion 24 may have a variety of configurations, such as a planar edge. In the embodiment shown, the end portion 24 is wider than the end portion 26, and such a configuration provides extra support for the shoe remover 10.

Each foot 36 may additionally have a medallion 38 coupled thereto. More specifically, the medallion 38 may have a protrusion that engages with a bore 39 in the foot 36. The medallion 38 may be permanently or removably fixed to the foot 36. The medallion 38 primarily serves a decorative function and may have any variety of designs. For example, the medallion 38 may be decorated with a monogram. In the illustrated embodiment, the medallion 38 has a sunburst design.

With reference now to FIG. 3, the end portion 26 is positioned adjacent an end portion of the member 14. The end portion 26 includes one or more barrels 40 forming a portion of a hinge assembly (described in detail below). One or more of the barrels 40 has a tab 41 extending downwardly therefrom, substantially parallel to an edge surface 46 of the end portion 26. The end portion 26 further includes at least one bore 42, each bore 42 being sized and shaped to receive a rod of the lock member 18 (described in detail below). The illustrated embodiment includes two bores 42. The bores 42 run between the cutout 34 and the edge surface 46 of the end portion 26. The end portion 26 further includes a bore 48 configured to receive a bolt 50 of the lock member 18. As illustrated, the bore 48 runs between the cutout 34 and the edge surface 46 of the end portion 26, similar to the bores 42. Alternatively, the bore 48 may not extend all the way to the edge surface 46.

With reference again to FIGS. 1-2A, the member 14 may be generally considered a shoe engagement member. The member 14 has two ends 54, 56 and an upper surface 58 and a lower surface 60. The end portion 54 is configured to engage a shoe. More specifically, the end portion 54 is configured to engage a rear portion (i.e., a portion about the heel) of the shoe. The end portion 54, as illustrated, has two legs 62 forming a generally U-shaped edge 64 running between the internal surfaces of the legs 62. However, the end portion 54 may also be generally V-shaped or another shape that is sufficient to snugly engage the shoe.

In an embodiment, a liner 66 is provided along the edge 64. The liner 66 may be composed of a soft plastic, leather, or any other material that protects the shoe from damage but has a high enough coefficient of friction to keep the shoe in snug engagement therewith.

With reference to FIG. 3, the end portion 56 is positioned adjacent the end portion 26 of the member 12. The end portion 56 includes one or more barrels 70 configured to cooperate with the one or more barrels 40 of the end portion 26. One or more of the barrels 70 has a tab 71 extending downwardly therefrom, substantially parallel to an edge surface 74 of the end portion 56. The end portion 56 further includes at least one aperture or bore 72 in the edge surface 74. The illustrated embodiment includes two apertures 72. The apertures 72 are sized and shaped to receive at least portions of the rods 92 of the locking member 18.

Figure 4:
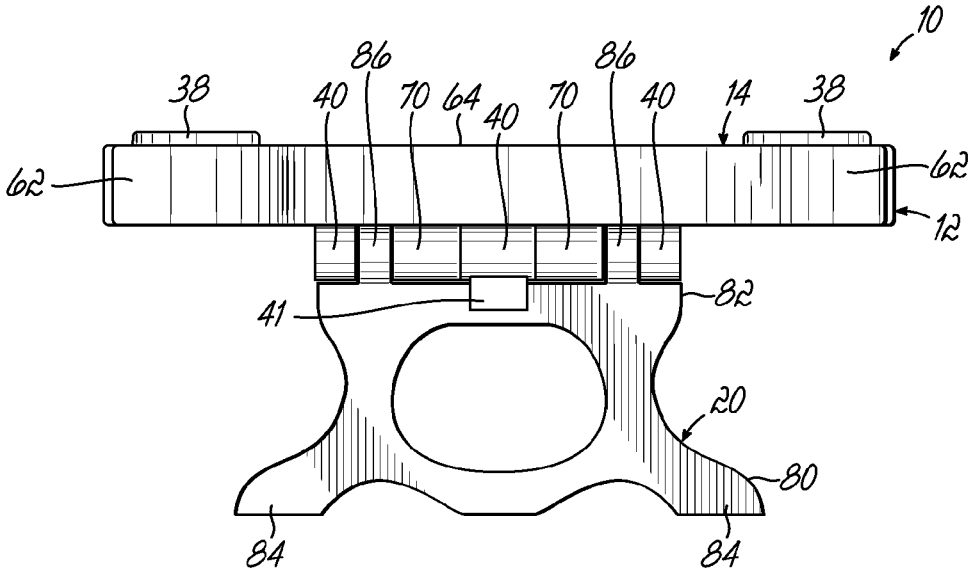
FIG. 4 is a front view of the shoe remover of FIG. 1.
Figure 5:
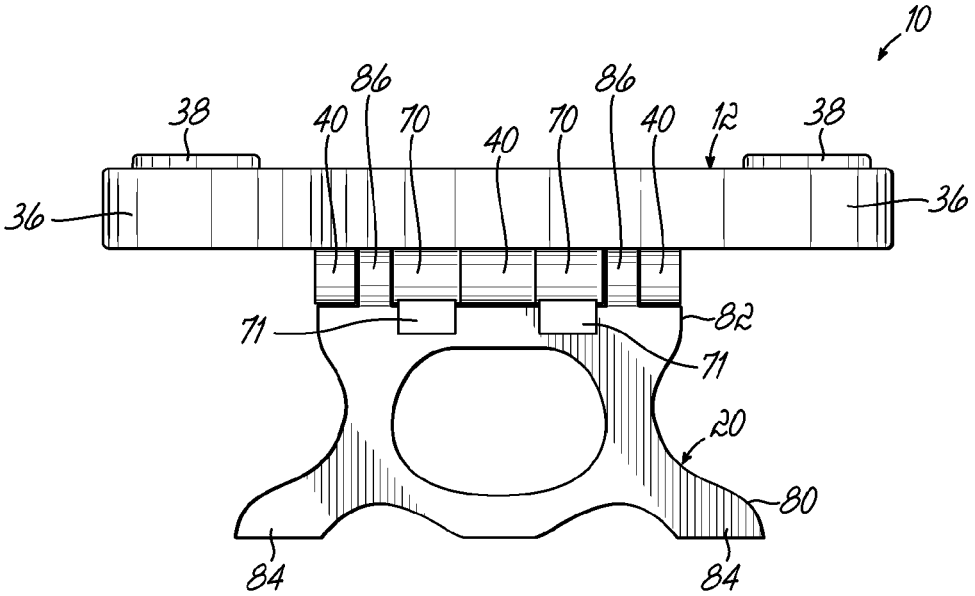
FIG. 5 is a rear view of the shoe remover of FIG. 1.
Figure 6:
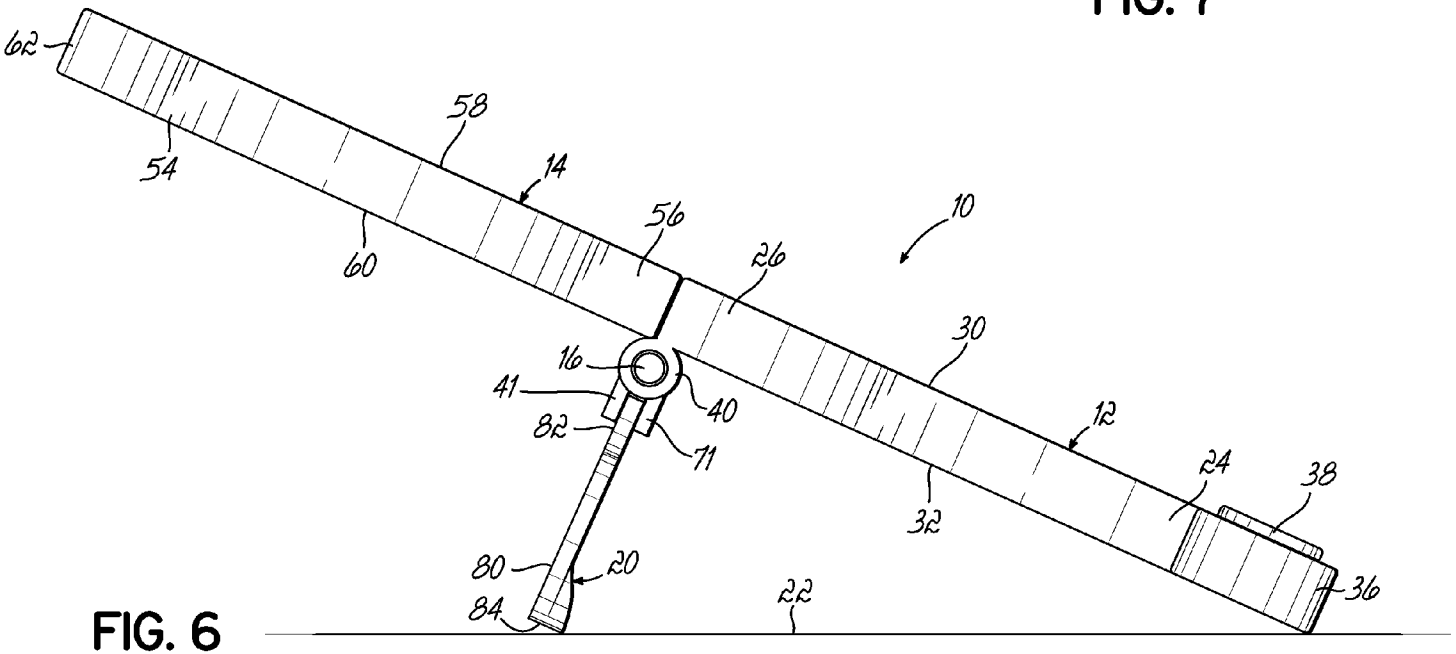
FIG. 6 is a side view of the shoe remover of FIG. 1.

With reference to FIGS. 3-5, a hinge assembly couples the members 12, 14. The barrels 40, 70 of the members 12, 14 are aligned and coupled together by the pin 16. As such, the members 12, 14 are configured to pivot between an open position (FIGS. 1-2A, 5), in which the upper surfaces 30, 58 are substantially co-planar and a collapsed or folded position (FIG. 6) in which the lower surfaces 32, 60 face one another and are positioned adjacent or proximate one another.

With continued reference to FIGS. 3-5, the upright support 20 is positioned intermediate the members 12, 14. The upright support 20 includes end portions 80, 82. The end portion 80 is configured to contact the support surface 22. In the embodiment shown, the end portion 80 comprises feet 84 that contact the support surface 22 (FIG. 1). However, one of ordinary skill will appreciate that the end portion 80 may have a variety of configurations, such as a planar edge. The end portion 82 is positioned adjacent the lower surface(s) 32, 60 of one or both of the members 12, 14. In the embodiment shown, the end portion 82 of the upright support 20 includes one or more barrels 86 that are configured to cooperate with the barrels 40, 70 of the members 12, 14, such that the upright support 20 is pivotally coupled to the shoe remover 10 by the hinge assembly. In another embodiment, however, the upright support 20 may be separately coupled to one of the members 12, 14. In the open position, the tabs 41, 71 contact and help stabilize the upright support 20.

With reference again to FIGS. 1-3, the shoe remover 10 further includes the lock member 18. The lock member 18 includes a handle portion 90 and one or more rods 92 extending therefrom. In the illustrated embodiment, two rods 92 extend from the handle portion 90. The handle portion 90 is positioned in the cutout 34 of the member 12, and the two rods 92 extend through the bores 42 in the end portion 26.

The handle portion 90 has a proximal end 94, a distal end 96, an upper surface 98, and a lower surface 100. A cutout 102 runs between the upper and lower surfaces 98, 100 thereof. As a result of the cutout 102, the proximal end 94 of the handle portion 90 is shaped so that it may be gripped by a user. The handle portion 90 includes a bore 104 that runs from an edge of the cutout 102 to the distal end 96 of the handle portion 90.

The bolt 50 is used to couple the lock member 18 to the member 12. The bolt 50 includes a threaded end portion 108. The threaded end portion 108 is threadably coupled in the bore 48 of the member 12. The bolt 50 further extends through the bore 104 of the lock member 18, such that the lock member 18 is in slidable engagement with the bolt 50. A head 110 of the bolt 50 is positioned within the cutout 102 of the lock member 18. The bolt 50 is longer than the combined lengths of the bore 48 and the bore 104, such that the lock member 18 may slide along a portion of the bolt 50. More specifically, the lock member 18 is of sufficient length to be slid between a locked position in which the rods 92 are engaged with the apertures 72 in the member 14 and an unlocked position in which the rods 92 are disengaged from the apertures 72. The head 110 is larger than the bore 104 such that the head 110 retains the lock member 18 in engagement with the bolt 50 even in the unlocked position (i.e., the lock member 18 cannot be slid off of the bolt 50). In other words, the head 50 serves as a stop for the lock member 18.

The shoe remover 10 is composed of a strong but lightweight material that is suitable for easy transport of the shoe remover 10. For example, the shoe remover 10 may be composed of titanium, aluminum, stainless steel, a polymer, a combination of these materials, or any other suitable material. To further reduce the amount of material required and, thus, the weight of the shoe remover 10, the lower surfaces 32, 60 of the members 12, 14 include channels or hollowed out areas 114, which reduces the amount of material required for the members 12, 14 and, thus, reduces the weight of the members 12, 14. Alternatively, however, the lower surfaces 32, 60 may also be planar, such that the member 12 is solid between the upper and lower surfaces 30, 32 or the channels or hollowed out spaces 114 are enclosed in an interior of the members 12, 14.

The shoe remover 10 may have a length of approximately 8-12" in the opened position, a folded length of approximately 4-6", and a maximum width (i.e., at one of the ends) of 4-5". More specifically, the shoe remover 10 may have a length of approximately 9⅜" in the opened position, a folded length of approximately 5", and a maximum width of 4⅝". As such, the folded shoe remover 10 easily fits in a suitcase or bag and is suitable for travel.

In use, from the closed or folded position with the lock member 18 pulled back in the unlocked position, one or both of the members 12, 14 is pivoted relative to the other member 12, 14 until rods 92 of the lock member 18 are substantially aligned with the apertures 72 of the member 14 and the upper surfaces 30, 58 of the members 12, 14 are substantially planar (FIG. 2A). The lock member 18 is then pushed in so that the rods 92 engage with the apertures 72. At this time, the lock member 18 is in the locked position (FIGS. 1, 2). Pivoting of the members 12, 14 relative to one another into the open position also automatically positions the upright support 20 to be ready for use.

The user then places the shoe remover 10 on the support surface 22 such that the feet 36 of the member 12 and the feet 84 of the upright support 20 contact the support surface 22. The user, who is wearing a boot or other shoe on one foot, positions his or her shoe between the legs 62 such that the shoe is frictionally engaged with at least a portion of the U-shaped edge 64. The user steps on the member 12 with his other foot to keep the shoe remover 10 in contact with the support surface 22 while pulling his other foot out of the shoe that is engaged with the U-shaped edge 64 in order to remove the shoe from his foot.

Figure 7:
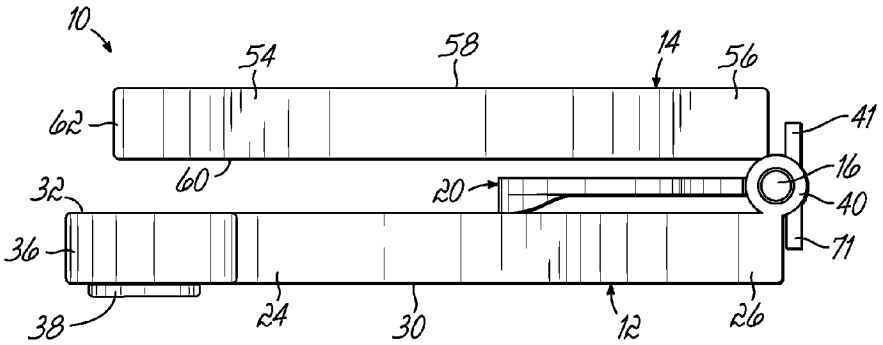
FIG. 7 is a side view of the shoe remover of FIG. 1 in a collapsed position.

Once the user has successfully removed his shoe with help from the shoe remover 10, the user removes his shoe from between the legs 62. The user may then wish to fold or close the shoe remover 10 for storage or to transport the shoe remover 10 to another location. To fold the shoe remover 10, the user holds the handle portion 90 of the lock member 18 and pulls the lock member 18 back toward the end of the member 12. When the rods 92 disengage from the apertures 72 (FIG. 2A), one or both of the members 12, 14 may be pivoted toward the other such to fold the shoe remover 10. When the shoe remover 10 is folded, the lower surfaces 32, 60 of the members 12, 14 are in close proximity, with the upright support 20 between the two members 12, 14 (FIG. 7).

While I have described several preferred embodiments of the present invention, persons skilled in the art will appreciate changes and modifications which may be made without departing from the spirit of the invention. Therefore, I intend portion to be limited only by the scope of the following claims and equivalents thereof:

I claim:

1. A shoe remover comprising:

a first member having first and second end portions, the first end portion having at least one aperture associated therewith and the second end portion being configured to engage a shoe;

a second member having first and second end portions, the first end portion being positioned proximate the first end portion of the first member and the second end portion being configured to contact a support surface;

a pin pivotally coupling the first member and the second member; and a lock member coupled to the second member, the lock member having at least one rod extending therefrom, the at least one rod being configured to releasably engage with the at least one aperture; and a bolt coupled to the second member and the lock member, the bolt having a head, wherein the lock member is slidingly engaged between the second member and the head, such that the head retains the lock member in engagement with the bolt even when the lock member is disengaged from the at least one aperture.

2. The shoe remover of claim 1 further comprising:

an upright support positioned proximate the first end portions of the first and second members, the upright support being configured to contact the support surface.

3. The shoe remover of claim 2, wherein the pin pivotally couples the upright support to the first and second members.

4. The shoe remover of claim 1, wherein the second end portion of the first member comprises a substantially U-shaped cutout.

5. The shoe remover of claim 4, further comprising:

a liner lining the cutout.

6. The shoe remover of claim 5, wherein the liner is composed of plastic.

7. The shoe remover of claim 1, wherein the first and second members are composed of at least one of titanium, aluminum, stainless steel, and a polymer.

8. The shoe remover of claim 1, wherein each of the first and second members has an upper face and a lower face, wherein in an open position, the lower faces of the first and second members face the support surface and the upper faces of the first and second members face away from the support surface.

9. The shoe remover of claim 8, wherein in the open position, the upper faces of the first and second members are substantially co-planar.

10. The shoe remover of claim 8, wherein in a folded position, the lower faces of the first and second members face one another.

11. The shoe remover of claim 8, wherein at least a portion of at least one of the lower faces includes a channel therein.

12. The shoe remover of claim 1, the second end portion of the second member further comprising:

two feet positioned at outermost portions of the second end portion of the second member, the two feet being configured to contact the support surface.

13. The shoe remover of claim 12, further comprising:

a medallion coupled to at least one foot.

14. The shoe remover of claim 13, further comprising:

a bore positioned in the at least one foot, wherein the medallion further has a protrusion that engages with the bore to couple the medallion to the at least one foot.

15. The shoe remover of claim 1, wherein the second member has a cutout in an intermediate portion thereof, the lock member being positioned within the cutout.

16. A method of using a shoe remover comprising a first member having first and second end portions, the first end portion having at least one aperture associated therewith and the second end portion being configured to engage shoe, a second member having first and second end portions, the first end portion being positioned proximate the first end portion of the first member and the second end portion being configured to contact a support surface, a pin pivotally coupling the first member and the second member, a lock member coupled to the second member, the lock member having at least one rod extending therefrom, the rod being configured to releasably engage with the at least one aperture, a bolt coupled to the second member and the lock member, the bolt having a head, the lock member being slidingly engaged between the second member and the head, the head being configured to retain the lock member in engagement with the bolt even when the lock member is disengaged from the at least one aperture, and an upright support positioned proximate the first end portions of the first and second members, the upright support being configured to contact the support surface, the method comprising:

pivoting at least one of the first and second members relative to the other of the first and second members until the at least one rod is substantially aligned with the at least one aperture;

sliding the lock member along the bolt to engage the at least one rod with the at least one aperture;

placing each of the second end portion of the second member and the upright support on the support surface; and engaging a shoe with the second end portion of the first member and using the shoe remover to remove the shoe.

17. The method of claim 16, further comprising:

pulling the lock member toward the second end portion of the second member so as to disengage the at least one rod from the at least one aperture; and pivoting the at least one of the first and second members toward the other of the first and second members.

18. A shoe remover comprising:

a first member having first and second end portions, the second end portion being configured to engage a shoe;

a second member having first and second end portions, the first end portion being pivotally coupled to the first end portion of the first member and the second end portion being configured to contact a support surface;

a lock member coupled to the second member, the lock member being configured to releasably engage with the first end portion of the first member; and a bolt coupled to the second member and the lock member, the bolt having a head, wherein the lock member is slidingly engaged between the second member and the head, such that the head retains the lock member in engagement with the bolt even when the lock member is disengaged from the first end portion of the first member.

19. The shoe remover of claim 18 further comprising a pin pivotally coupling the first member and the second member.

20. The shoe remover of claim 18, wherein the second member has a cutout in an intermediate portion thereof, the lock member being positioned within the cutout.

* * * * *

UNITED STATES PATENT AND TRADEMARK OFFICE

CERTIFICATE OF CORRECTION

PATENT NO. : 9,192,259 B2
APPLICATION NO. : 14/667782
DATED : November 24, 2015
INVENTOR(S) : Richard Koskovich It is certified that error appears in the above-identified patent and that said Letters Patent is hereby corrected as shown below:

IN THE SPECIFICATION

Column 1

Line 21, delete "portion".

Line 48, "engage shoe" should be ---engage a shoe---.

Line 55, "at least rod" should be ---at least one rod---.

Column 5

Line 36, delete "portion".

IN THE CLAIMS

Claim 16, Column 6

Line 43, "engage shoe" should be ---engage a shoe---.

Signed and Sealed this
Fifth Day of April, 2016

Michelle K. Lee

Michelle K. Lee
*Director of the United States Patent and Trademark Office*